US009580218B2

(12) United States Patent
Choi

(10) Patent No.: US 9,580,218 B2
(45) Date of Patent: Feb. 28, 2017

(54) CAP STRUCTURE FOR VESSEL

(71) Applicant: Jong-Suh Choi, Hwaseong-si (KR)

(72) Inventor: Jong-Suh Choi, Hwaseong-si (KR)

( * ) Notice: Subject to any disclaimer, the term of this patent is extended or adjusted under 35 U.S.C. 154(b) by 0 days.

(21) Appl. No.: 14/984,429

(22) Filed: Dec. 30, 2015

(65) Prior Publication Data

US 2016/0107810 A1 Apr. 21, 2016

Related U.S. Application Data

(62) Division of application No. 14/152,858, filed on Jan. 10, 2014, now Pat. No. 9,434,517.

(30) Foreign Application Priority Data

Dec. 6, 2013 (KR) ..... 10-2013-0151067
Dec. 27, 2013 (KR) ..... 10-2013-0165308

(51) Int. Cl.

| | |
|---|---|
| ***A46B 11/00*** | (2006.01) |
| ***B65D 51/18*** | (2006.01) |
| ***B65D 55/02*** | (2006.01) |
| ***B65D 39/08*** | (2006.01) |
| ***B65D 51/32*** | (2006.01) |
| *A45D 34/04* | (2006.01) |
| *A45D 40/26* | (2006.01) |

(52) U.S. Cl.

CPC ..... *B65D 51/18* (2013.01); *A45D 34/04* (2013.01); *A45D 40/26* (2013.01); *B65D 39/08* (2013.01); *B65D 39/086* (2013.01); *B65D 51/32* (2013.01); *B65D 55/02* (2013.01); *A45D 34/045* (2013.01); *A45D 40/265* (2013.01); *A45D 2200/05* (2013.01); *B65D 2251/009* (2013.01); *B65D 2251/0012* (2013.01); *B65D 2251/0028* (2013.01)

(58) Field of Classification Search

CPC ..... B65D 51/18; B65D 39/08; B65D 51/32; B65D 39/086; B65D 55/02; B65D 2251/0028; B65D 2251/009; B65D 2251/0012; A45D 40/26; A45D 34/04; A45D 2200/05; A45D 34/045

USPC ..... 215/216, 220, 228; 220/212, 787, 800; 401/126–130

See application file for complete search history.

(56) References Cited

U.S. PATENT DOCUMENTS

| | | | | |
|---|---|---|---|---|
| 3,881,624 | A * | 5/1975 | Dougherty, Sr. .... | B65D 50/046 141/24 |
| 4,286,633 | A * | 9/1981 | Herr ..... | B65D 50/041 141/24 |
| 4,383,618 | A * | 5/1983 | Dougherty ..... | B65D 50/046 215/216 |

* cited by examiner

*Primary Examiner* — James N Smalley
(74) *Attorney, Agent, or Firm* — Novick, Kim & Lee PLLC; Jae Youn Kim

(57) ABSTRACT

Provided is a cap structure for a vessel, which is coupled with the vessel to open/close the vessel. The cap includes an inner cap coupled with an upper end portion of the vessel, an outer cap fitted around an outer diameter of the inner cap, a circular part inserted into the mounting part, in which the circular part includes protrusions, which are smoothly curved, and first detachable protrusions formed at a position perpendicular to the protrusions, a deformation member to deform a shape of the circular part, and a component inserted into the inner cap and the circular part and having a first detachable groove circumferentially formed at a lower portion of an outer-diameter surface of a coupling part formed on the component. The cap opens/closes the vessel by fixedly attaching the component to the cap disassembled from the vessel or separating the component from the cap.

5 Claims, 6 Drawing Sheets

CAP STRUCTURE FOR VESSEL

CROSS-REFERENCE TO RELATED APPLICATIONS

This application is a divisional application of U.S. patent application Ser. No. 14/152,858 filed on Jan. 10, 2014, which claims priority to Korean patent application Nos. 10-2013-0151067 and 10-2013-0165308 filed on Dec. 6, 2013, and Dec. 27, 2013, respectively.

BACKGROUND OF THE INVENTION

1. Field of the Invention

The present invention relates a cap structure for a vessel. In particular, the present invention relates to a cap structure for a vessel, capable of opening/closing the vessel by fixedly coupling a component attached to the cap with the cap, or separating the component from the cap to open the vessel in the state that the cap is not separated from the vessel.

2. Description of the Related Art

In general, to continuously open/close a cap coupled with a vessel with respect to the vessel, a screw-coupling structure is employed.

However, the conventional screw-coupling structure requires a user to inconveniently rotate the cap several times in order to open/close the cap. However, whenever the cap is open/closed, the cap must be inconveniently rotated each time.

Meanwhile, for example, when the vessel is employed for a vessel of cosmetics, as shown in FIG. 1, a cap 3 may be coupled with a vessel 1 in a screw structure, and a pipette, a mascara stick or the like may be coupled integrally with the cap 3.

In this case, when a user intends to use a cosmetic liquid contained in the vessel 1, the user must inconveniently separate the cap 2 from the vessel 1 as shown in FIG. 1 by rotating the cap 2 several times for the use of a material contained in the vessel 1.

Therefore, when a pipette, a mascara stick, or a mascara brush integrated with the cap 3 is used in the separated state from the vessel 1, the user must use the pipette, the mascara stick or the mascara brush having a low end portion spaced apart from the floor of the vessel 1 by a predetermined distance, so that the user does not use liquid remaining on the floor of the vessel 1 by using the pipette, so the user must overturn the vessel 1 and directly apply the liquid to a palm or an affected area of the user. Accordingly, high-price cosmetics may be wasted.

SUMMARY OF THE INVENTION

Accordingly, the present invention has been made keeping in mind the above problems occurring in the prior art, and the present invention provides a cap structure for a vessel, capable of opening/closing the vessel by fixedly attaching components to the cap or separating the components from the cap in the state that the cap is disassembled from the vessel.

In order to accomplish the above object, there is provided a cap structure for a vessel, which is coupled with the vessel to open/close the vessel. The cap includes an inner cap having a cylindrical shape, coupled with an upper end portion of the vessel to open/close the vessel, and provided at an inner-diameter surface thereof with a mounting part having a predetermined width, an outer cap having a cylindrical shape and fitted around an outer diameter of the inner cap so as to be coupled with the inner cap, a circular part inserted into the mounting part and mounted in the mounting part such that the circular part is inwardly spaced apart from the inner-diameter surface of the inner cap by a predetermined distance, in which the circular part comprises protrusions, which are smoothly curved, on opposite positions of an outer-diameter surface of the circular part such that the protrusions make contact with the inner-diameter surface of the inner cap, and first detachable protrusions formed at an inner-diameter surface of the circular part at a position perpendicular to the protrusions, a deformation member to deform a shape of the circular part from a circular shape to an oval shape, or from the oval shape to the circular shape, and a component inserted into the inner cap and the circular part and having a first detachable groove circumferentially formed at a lower portion of an outer-diameter surface of a coupling part formed on the component such that the first detachable groove is fitted around the first detachable protrusion.

In this case, the deformation member includes a plurality of fixing protrusions protruding downward from an upper end portion of the outer cap, provided at both sides of the first detachable protrusion, and rotating the circular part together with the outer cap when the outer cap is rotated, and at least one pressing protrusion formed on the inner-diameter surface of the inner cap and pressing the protrusion of the circular part in a central direction.

Further, the deformation member includes a guiding groove formed in a top surface of the first detachable protrusion of the circular part while longitudinally extending toward a circular center, and a guiding protrusion protruding downward from an upper end portion of the outer cap and inserted into the guiding groove such that the circular part is rotated when the outer cap is rotated.

Meanwhile, according to another aspect of the present invention, there is provided a cap structure for a vessel, which is coupled with the vessel to open/close the vessel. The cap includes an inner cap having a cylindrical shape, coupled with an upper end portion of the vessel to open/close the vessel, and provided at an inner-diameter surface thereof with a mounting part having a predetermined width, an outer cap having a cylindrical shape and fitted around an outer-diameter surface of the inner cap such that the outer cap is coupled with the inner cap, a circular part inserted into the mounting part and mounted in the mounting part such that the circular part is inwardly spaced apart from the inner-diameter surface of the inner cap by a predetermined distance, in which the circular part comprises protrusions formed in a smoothly curved shape on opposite positions of an outer-diameter surface of the circular part such that the protrusions make contact with the inner-diameter surface of the inner cap, and second detachable protrusions formed at an inner-diameter surface of the circular part at positions perpendicular to the protrusions, a deformation member to deform a shape of the circular part from a circular shape to an oval shape, or from the oval shape to the circular shape, and a component inserted into the inner cap and the circular part and having a second detachable protrusion circumferentially protruding from an outer-diameter surface of a coupling part formed at a lower portion of the component such that the second detachable protrusion is inserted into the second detachable groove.

In this case, the deformation member includes a plurality of fixing protrusions protruding downward from an upper end portion of the outer cap, provided at both sides of the second detachable groove, and rotating the circular part together with the outer cap when the outer cap is rotated, and at least one pressing protrusion formed on the inner-diameter surface of the inner cap and pressing the protrusion of the circular part in a central direction.

In addition, the deformation member includes a guiding groove formed in a top surface of the second detachable groove of the circular part while longitudinally extending toward a circular center, and a guiding protrusion protruding downward from an upper end portion of the outer cap and inserted into the guiding groove such that the circular part is rotated when the outer cap is rotated.

Further, preferably, the cap further includes a stopper protruding from the outer-diameter surface of the inner cap while vertically extending, and a vertical protrusion protruding from an inner-diameter surface of the outer cap while vertically extending to prevent the outer cap from being rotated in a reverse direction after the outer cap has been rotated in one direction and gone beyond the stopper.

In addition, preferably, the outer cap is provided at a lower end portion of an inner-diameter surface thereof with a locking groove such that the locking groove is downward fitted around at least one fixing step protruding from a lower end portion of the outer-diameter surface of the inner cap.

As described above, the present invention has following effects.

First, the component of the cap is fixedly locked or released from the locking state only by rotating the outer cap at a predetermined angle in a forward direction or a reverse direction, so that the component of the cap can be simply open/closed.

Second, the component is locked or released from the state that the component is not moved up and down, or locked or separated while being slightly moved up and down, so that the pumping tube of the pipette or the mascara stick or the mascara brush coupled with the component is closely provided to the floor of the vessel when the component is used. Accordingly, a most amount of cosmetics remaining on the floor of the vessel can be used.

Third, the component is designed to have a structure in which the component is fixedly locked or released from the locking state while the component is being moved up and down to appear. The component can be designed in the various shapes or various structures. Accordingly, the purchase need of a consumer can be increased.

DETAILED DESCRIPTION OF THE INVENTION

Hereinafter, the structure and the operation of the present invention will be described with reference to FIGS. 2 to 7. The first and second embodiments make a difference only in the constitution of a deformation member to deform the shape of a circular part 700, which is described later, from a circular shape to an oval shape. Accordingly, after describing the structure and the operation of the first embodiment, the structure and the operation of the second embodiment will be described while focusing on a deformation member of the second embodiment having a structure different from that of a deformation member of the first embodiment.

First Embodiment

Although it is easy to couple the inner cap 200 having a cylindrical shape with an upper end portion of the vessel 1 of the cosmetics according to the present invention through a screw coupling scheme, the present invention is not limited to the coupling scheme, but employs various typical coupling schemes.

Figure 1:
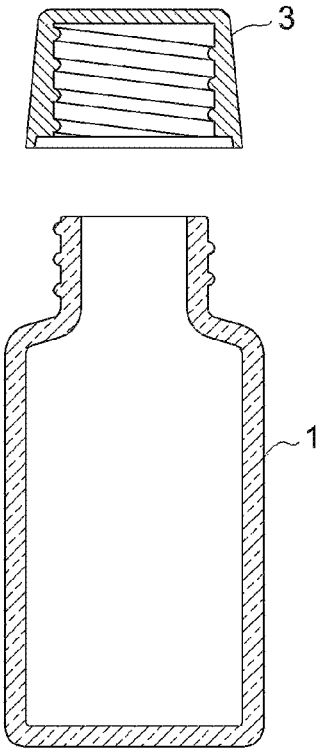
PRIOR ART FIG. 1
FIG. 1 is a sectional view showing the state that a component is separated from a vessel according to the related art.
Figure 2:
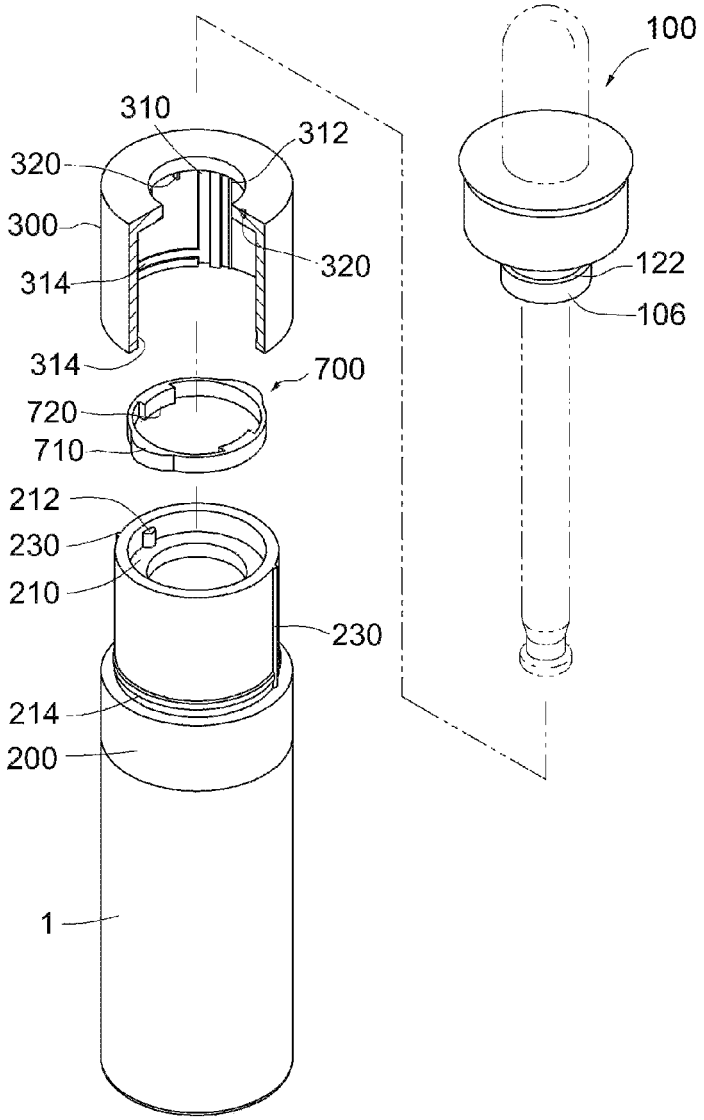
FIG. 2 is an exploded perspective view showing a structure according to a first embodiment of the present invention.

As shown in FIG. 2, the outer cap 300 having a cylindrical shape is downward fitted around an outer-diameter surface of the inner cap 200. In this case, the outer cap 300 has a structure of freely rotating in the state that the outer cap 300 is coupled with the inner cap 200. Preferably, at least one fixing step 214 is circumferentially molded in the form of a protrusion on the outer-diameter surface of the inner cap 200, and a locking groove 314 is circumferentially molded in a lower end portion of an inner-diameter surface of the outer cap 300 so that the locking groove 314 is downward fitted around the fixing step 214. Accordingly, the outer cap 300 can be freely rotated in the state that the outer cap 300 is coupled with the inner cap 200.

As shown in FIG. 2, the inner cap 200 has a cylindrical structure in which a mounting part 210 is formed by protruding inward of the inner-diameter surface of the inner cap 200 by a predetermined width.

In addition, as shown in FIG. 2, the circular part 700 having a cylindrical shape is inserted and mounted on the mounting part 210. In this case, an outer-diameter surface of the circular part 700 is spaced apart from the inner-diameter surface of the inner cap 200 by a predetermined distance.

Protrusions 710 are molded on the outer-diameter surface of the circular part 700 while being gently curved. The protrusions 710 are formed symmetrically to each other in opposition to each other and then make contact with the inner-diameter surface of the inner cap 200.

The first embodiment suggests two examples of a structure in which the component 100 inserted into the inner cap 200 is locked or the locking state of the component 100 is released.

Figure 3:
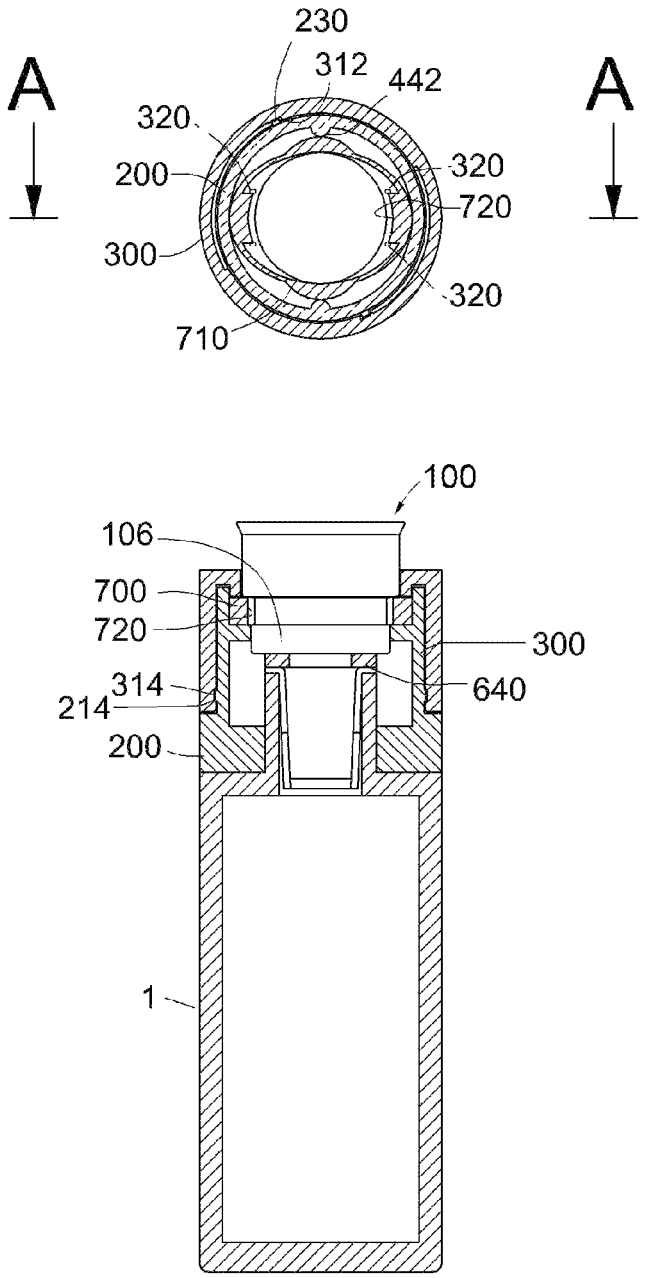
FIG. 3 illustrates a cross sectional view and an A-A line longitudinal sectional view showing the state that the component is separated from the vessel according to the first embodiment of the present invention.

First, a first detachable protrusion 720 is molded at a position of the inner-diameter surface of the circular part 700 perpendicular to the protrusion 710 as shown in FIGS. 2 and 3, so that the first detachable protrusion 720 is inserted into a first detachable groove 122 formed in the outer-diameter surface of the coupling part 106 formed at a lower portion of the component 100 to be described later.

Figure 7:
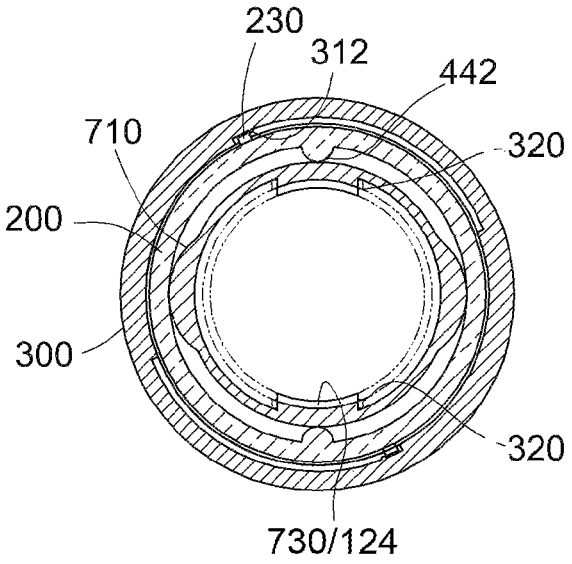
FIG. 7 is a cross sectional view showing still another embodiment of the present invention.

Second, as shown in FIG. 7, a second detachable groove 730 is molded in a position of the inner-diameter surface perpendicular to the protrusion 710 of the circular part 700, and a second detachable protrusion 124 is circumferentially molded from the outer-diameter surface of the coupling part 106 of the component 100, so that the second detachable groove 730 is fitted around the second detachable protrusion 124 to fix the component 100.

Meanwhile, hereinafter, description will be made regarding a deforming member to change the shape of the circular part 700 from a circular shape to an oval shape to insert/separate the first detachable protrusion 720 into/from the first detachable groove 122, or to insert/separate the second detachable groove 730 into/from the second detachable protrusion 124.

At least one pressing protrusion 212 is molded on the inner-diameter surface connected with the mounting part 210 of the inner cap 200. When the circular part 700 is rotated as the outer cap 300 is rotated, the protrusion 710 of the circular part 700 may be pressed in the central direction by the pressing protrusion 212.

Figure 4:
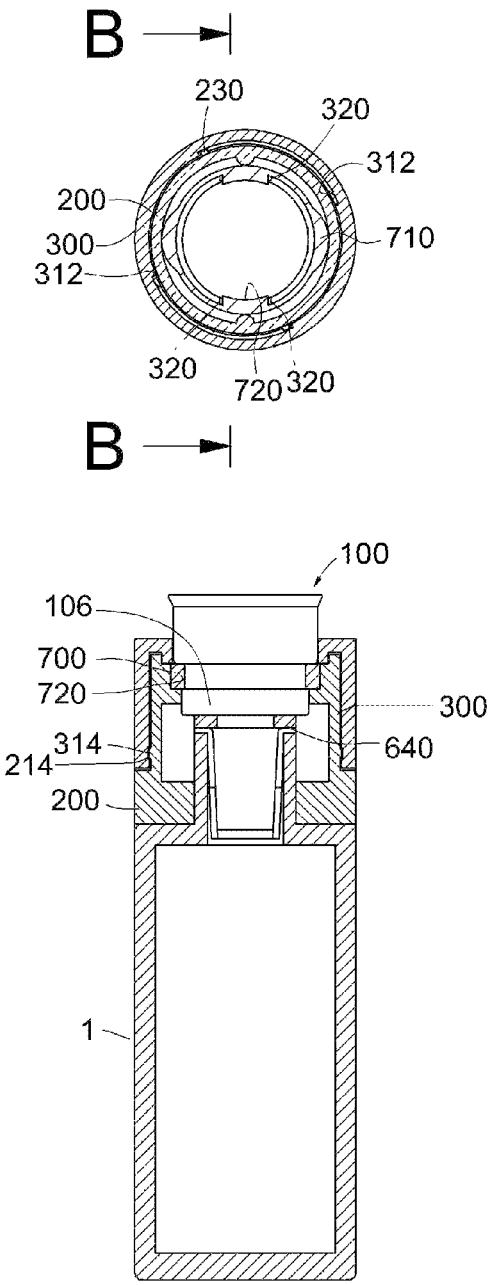
FIG. 4 illustrates a cross sectional view and a line B-B longitudinal sectional view showing that the component according to the present invention is fixedly locked.

In other words, a plurality of fixing protrusions 320, which are downward molded as shown in FIG. 3, are provided at both sides of the first detachable protrusion 720 as shown in FIGS. 3 and 4. Accordingly, when the outer cap 300 is rotated, the circular part 700 is rotated together, so that the protrusion 710 makes contact with the pressing protrusion 212, thereby pressing the protrusion 710 of the circular part 700 from the state of FIG. 3 to the state of FIG. 4.

Meanwhile, as shown in FIGS. 2 and 4, a stopper 230 protrudes from the outer-diameter surface of the inner cap 200 while vertically extending, and a vertical protrusion 312 is molded from the inner-diameter surface of the outer cap 300 while vertically extending corresponding to the stopper 230.

Accordingly, when the vertical protrusion 312 of the outer cap 300 rotates in one direction to go beyond the stopper 230 and then the outer cap 300 unintentionally attempts to rotate in the reverse direction, the reverse rotation of the outer cap 300 can be prevented due to the interference between the second stopper 230 and the vertical protrusion 312.

Hereinafter, the operating state of the first embodiment having the above structure will be described with reference to FIGS. 3 and 4.

As shown in the cross sectional view of FIG. 3, the shape of the circular part 700 having elasticity is deformed to an oval shape as the pressing protrusion 212 of the inner cap 200 presses the protrusion 710 of the circular part 700. In this case, the first detachable protrusion 720 protruding from the inner-diameter surface of the circular part 700 is moved longitudinally, so that the first detachable protrusion 720 is separated from the first detachable groove 122.

In this case, preferably, the vertical protrusion 312 of the outer cap 300 is maintained in a stop state by the stopper 230.

That is to say, since the circular part 700, which is deformed in an oval shape, has elasticity to return to a circular shape, the outer cap 300 is maintained in the stop state by the stopper 230 and the vertical protrusion 312, thereby maintaining the circular part 700 in the oval shape.

As shown in FIG. 3, the first detachable protrusion 720 of the circular part 700 is separated from the first detachable groove 122 formed in the outer-diameter surface of the coupling part 109 of the component 100. In this state, the vessel 100 can be open by separating the component 100 from the vessel.

In addition, as shown in FIG. 3, if the component 100 is inserted into the vessel 1 through the inner cap 200, the lower end portion of the coupling part 106 is mounted on the upper end portion of the packing member 640 as shown in the longitudinal sectional view of FIG. 3, or the lower end portion of the coupling part 106 is mounted on the upper end portion of the inner cap 200. In order to fixedly lock the component 100 into the inner cap 200 in the above state, the outer cap 300 is rotated clockwise as shown in FIG. 4, so that the circular part 700 is rotated clockwise by the fixing protrusion 320.

Accordingly, if the circular part 700 is rotated, the protrusion part 710 pressed by the pressing protrusion 212 is released, so that the shape of the circular part 700 returns to a circular shape by the elasticity of the circular part 700. In this case, the first detachable protrusion 720 protruding from the circular part 700 is inserted into the first detachable groove 122 of the coupling part 106 of the component 100 to fixedly lock the component 100.

Meanwhile, in order to release the component 100, which is fixedly locked, the outer cap 300 is rotated counterclockwise. The stopper 230 formed on the inner cap 200 forcibly goes beyond the vertical protrusion 312 protruding from the outer cap 300, so that the stopper 230 is released from the stop state and rotated. In this case, the fixing protrusion 320 formed on the outer cap 300 rotates the circular part 700 counterclockwise.

In this case, the protrusion 710 of the circular part 700 is rotated to the pressing protrusion 212 formed on the inner-diameter surface of the inner cap 200 and pressed by the pressing protrusion 212. Accordingly, the shape of the circular part 700 is deformed to the oval shape, and the first detachable protrusion 720 is separated from the first detachable groove 122, so that the component 100 is separated from the inner cap 200.

Second Embodiment

The second embodiment makes a difference from the first embodiment only in the structure of the deformation member. Accordingly, hereinafter, only the difference in the structure of the deformation member between the second and first embodiments will be described, and the whole structure of the second embodiment will be described based on the described of the operation thereof.

Figure 5:
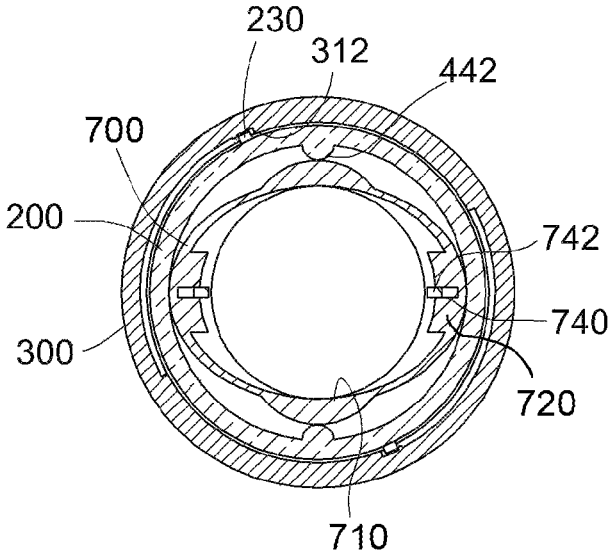
FIG. 5 is a cross sectional view showing the state that a component is separated according to another embodiment of the present invention.

As shown in FIG. 5, a top surface of the first detachable protrusion 720 of the circular part 700 mounted in the mounting part 210 of the inner cap 200 is provided therein with a guiding groove 740 longitudinally formed toward the circular center, and the outer cap 300 is provided at the upper end portion thereof with a guiding protrusion 742 molded downward.

Therefore, if the guiding protrusion 742 is inserted into the guiding groove 740, when the outer cap 300 is rotated, the outer cap 300 may rotate the circular part 700 because the guiding protrusion 742 is inserted into the guiding groove 740.

In addition, the second embodiment suggests two examples of a structure in which the component 100 inserted into the inner cap 200 is locked or the locking state of the component 100 is released.

First, the first detachable protrusion 720 is molded at a position of the inner-diameter surface of the circular part 700 perpendicular to the protrusion 710 as shown in FIGS. 2 and 3, so that the first detachable protrusion 720 is inserted into the first detachable groove 122 formed in the outer-diameter surface of the coupling part 106 of the component 100 to be described later.

Second, as shown in FIG. 7, the second detachable groove 730 is molded in the form of a protrusion at a position of the inner-diameter surface perpendicular to the protrusion 710 of the circular part 700, and the second detachable protrusion 124 is circumferentially molded from the outer-diameter surface of the coupling part 106 of the component 100, so that the second detachable groove 730 is fitted around the second detachable protrusion 124 to fix the component 100.

Figure 6:
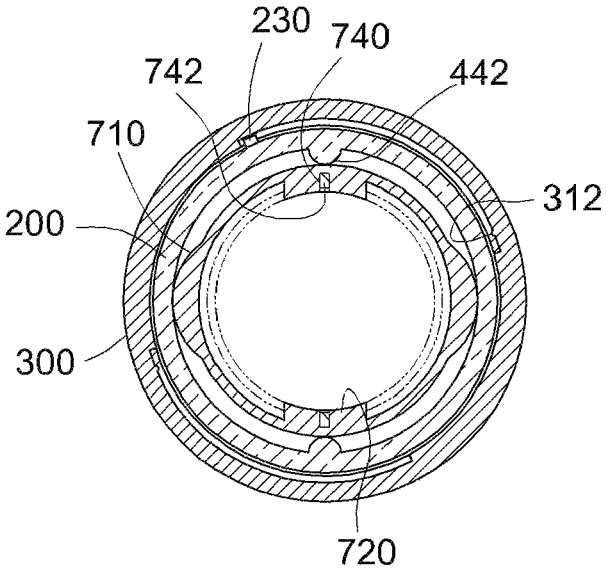
FIG. 6 is a cross sectional view showing the state that the component is fixedly locked according to another embodiment of the present invention.

Meanwhile, as shown in FIGS. 5 and 6, the stopper 230 protrudes from the outer-diameter surface of the inner cap 200 while vertically extending, and the vertical protrusion 312 is molded from the inner-diameter surface of the outer cap 300 while vertically extending corresponding to the stopper 230.

Accordingly, when the vertical protrusion 312 of the outer cap 300 rotates in one direction to go beyond the stopper 230 and then the outer cap 300 unintentionally attempts to rotate in the reverse direction, the reverse rotation of the outer cap 300 can be prevented due to the interference between the second stopper 230 and the vertical protrusion 312.

Hereinafter, the operating state of the second embodiment having the above structure will be described with reference to FIGS. 5 and 6.

The cross sectional view of FIG. 5 shows that the shape of the circular part 700 having elasticity is deformed to an oval shape as the protrusion 710 of the circular part 700 is pressed by the pressing protrusion 212 of the inner cap 200.

In this case, the first detachable protrusion 720 protruding from the inner-diameter surface of the circular part 700 is moved longitudinally, so that the first detachable protrusion 720 is separated from the first detachable groove 122 formed in the coupling part 106 of the component 100, and the vertical protrusion 312 of the outer cap 300 is maintained in the stop state by the stopper 230.

Further, in order to fixedly lock the component 100 to the inner cap 200 after the component 100 has been inserted through the inner cap 200 as shown in FIG. 5, the circular part 700 is rotated clockwise by the guiding protrusion 742 inserted into the guiding groove 740 by rotating the outer cap 300 clockwise as shown in FIG. 6.

Accordingly, if the circular part 700 is rotated, the protrusion part 710 pressed by the pressing protrusion 212 is released, so that the shape of the circular part 700 returns to a circular shape by the elasticity of the circular part 700 as shown in FIG. 6. In this case, the first detachable protrusion 720 formed on the inner-diameter surface of the circular part 700 is inserted into the first detachable groove 122 of the coupling part 106 of the component 100 to fixedly lock the component 100.

Meanwhile, in order to release the component 100, which is fixedly locked, the outer cap 300 is rotated counterclockwise. The stopper 230 formed on the inner cap 200 forcibly goes beyond the vertical protrusion 312 protruding from the outer cap 300, so that the stopper 230 is released from the stop state and rotated. In this case, the fixing protrusion 320 formed on the outer cap 300 rotates the circular part 700 counterclockwise.

In this case, the protrusion 710 of the circular part 700 is rotated to the pressing protrusion 212 formed on the inner-diameter surface of the inner cap 200 and pressed by the pressing protrusion 212. Accordingly, the shape of the circular part 700 is deformed to the oval shape, and the first detachable protrusion 720 is separated from the first detachable groove 122, so that the component 100 is separated from the inner cap 200.

As described above, the present invention relates to a cap structure coupled with a vessel. The component attached to the cap can be easily and simply open and closed for the convenient use. In particular, as shown in FIG. 2, a pipette, a mascara stick, or a mascara brush is coupled with the component, so that an appliance coupled with the component can be simply used.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap structure for a vessel, which is coupled with the vessel to open/close the vessel, the cap structure comprising:

an inner cap having a cylindrical shape, coupled with an upper end portion of the vessel to open/close the vessel, and including a mounting part having a predetermined width and disposed at an inner-diameter surface thereof;

an outer cap having a cylindrical shape and fitted around an outer-diameter surface of the inner cap so as to be coupled with the inner cap;

a circular part inserted into the mounting part and mounted in the mounting part such that at least one portion of the circular part is inwardly spaced apart from the inner-diameter surface of the inner cap by a predetermined distance, the circular part comprising protrusions, which are smoothly curved, disposed on an outer-diameter surface of the circular part such that the protrusions make contact with the inner-diameter surface of the inner cap, and a detachable groove disposed on an inner-diameter surface of the circular part, wherein a diameter of the circular part passing through the center of one of the protrusions is perpendicular to another diameter of the circular part passing through the center of the detachable groove;

a deformation member to deform a shape of the circular part from a circular shape to an oval shape, or from the oval shape to the circular shape; and a component inserted into the inner cap and the circular part and having a detachable protrusion circumferentially protruding from an outer-diameter surface of a coupling part disposed at a lower portion of the component such that the detachable protrusion is fitted around the detachable groove.

2. The cap structure of claim 1, wherein the deformation member comprises:

a plurality of fixing protrusions protruding downward from an upper end portion of the outer cap, provided at both sides of the detachable groove, and rotating the circular part together with the outer cap when the outer cap is rotated; and at least one pressing protrusion formed on the inner-diameter surface of the inner cap and pressing the protrusion of the circular part in a central direction.

3. The cap structure of claim 1, wherein the deformation member comprises:

a guiding groove disposed in a top surface of the detachable groove of the circular part while longitudinally extending toward a circular center; and a guiding protrusion protruding downward from an upper end portion of the outer cap and inserted into the guiding groove such that the circular part is rotated when the outer cap is rotated.

4. The cap structure of claim 1, further comprising:

a stopper protruding from the outer-diameter surface of the inner cap while vertically extending; and a vertical protrusion protruding from an inner-diameter surface of the outer cap while vertically extending to prevent the outer cap from being rotated in a reverse direction after the outer cap has been rotated in one direction and gone beyond the stopper.

5. The cap structure of claim 1, wherein the outer cap includes a locking groove disposed at a lower end portion of an inner-diameter surface thereof such that the locking groove is downward fitted around at least one fixing step protruding from a lower end portion of the outer-diameter surface of the inner cap.

* * * * *